US009717652B2

(12) United States Patent
Geboers

(10) Patent No.: US 9,717,652 B2
(45) Date of Patent: Aug. 1, 2017

(54) ADD-ON UNIT FOR A HANDHELD CONTAINER FOR STORING OBJECTS

(71) Applicant: MISSIO B.V., Valkenswaard (NL)

(72) Inventor: Josephus Joannes Antonius Geboers, Valkenswaard (NL)

(73) Assignee: MISSIO B.V., Valkenswaard (NL)

( * ) Notice: Subject to any disclaimer, the term of this patent is extended or adjusted under 35 U.S.C. 154(b) by 0 days.

(21) Appl. No.: 15/129,470

(22) PCT Filed: Mar. 26, 2015

(86) PCT No.: PCT/EP2015/056652

§ 371 (c)(1),
(2) Date: Sep. 27, 2016

(87) PCT Pub. No.: WO2015/150240

PCT Pub. Date: Oct. 8, 2015

(65) Prior Publication Data

US 2017/0119628 A1 May 4, 2017

(30) Foreign Application Priority Data

Apr. 2, 2014 (EP) ..... 14163142

(51) Int. Cl.
*G08B 9/00* (2006.01)
*A61J 7/00* (2006.01)
(Continued)

(52) U.S. Cl.
CPC ..... *A61J 7/0076* (2013.01); *A61J 1/03* (2013.01); *A61J 7/02* (2013.01); *A61J 7/0418* (2015.05)

(58) Field of Classification Search
CPC .... A61J 1/03; A61J 7/0076; A61J 7/02; A61J 7/0418
(Continued)

(56) References Cited

U.S. PATENT DOCUMENTS 6,108,588 A 8/2000 McGrady
8,727,180 B2 * 5/2014 Zonana ..... B65D 83/0409 221/195
(Continued)

FOREIGN PATENT DOCUMENTS

WO 90/05684 A1 5/1990
WO 2005/004786 A1 1/2005
(Continued)

*Primary Examiner* — Nader Bolourchi
(74) *Attorney, Agent, or Firm* — Richard M. Goldberg

(57) ABSTRACT

An add-on unit for a handheld container, preferably a medication container, for storing medication objects, e.g. pills, to be dispensed, includes an open channel with dimensions enabling a free passage of an object to leave the container under influence of a gravity force without using a dispensing mechanism. Shaking the medication container while it is held in a slanting upside down position causes that objects are moved to the channel and will fall through the channel to leave the container. A detector detects the object which passes the channel. Electronic circuitry derives and stores information related to one or more detected passages of objects. The add-on unit is provided with an interface for communication with the outside world for outputting the information derived. Preferably the add-on unit has the form of an insert unit which fits in the neck of a standard container.

29 Claims, 7 Drawing Sheets

Figure 1:
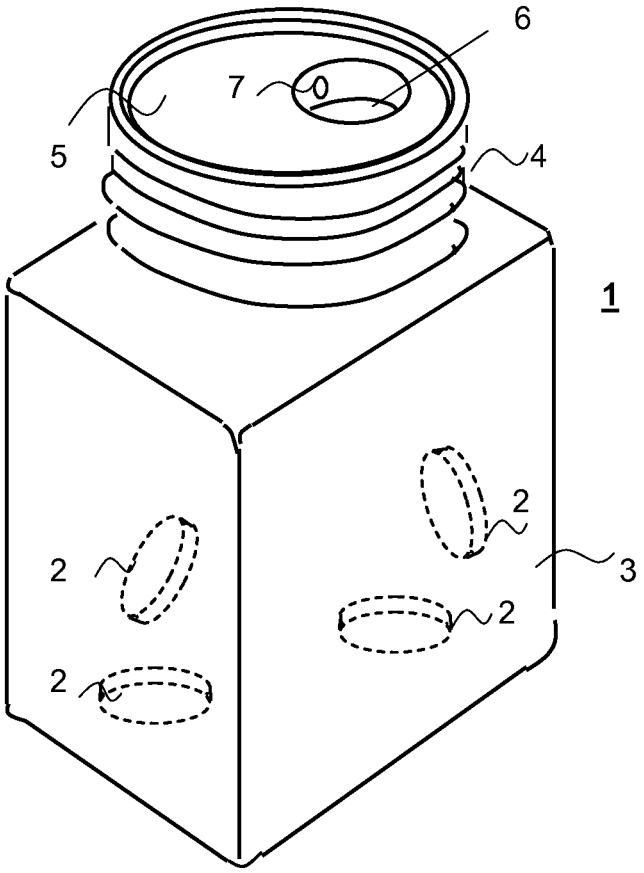

(51) Int. Cl.
*A61J 7/02* (2006.01)
*A61J 7/04* (2006.01)
*A61J 1/03* (2006.01)

(58) Field of Classification Search
USPC ..... 340/286.02
See application file for complete search history.

(56) References Cited

U.S. PATENT DOCUMENTS 8,963,710 B2 2/2015 Huang et al.
2001/0028308 A1* 10/2001 De La Huerga .. A61M 5/14212 340/573.1
2006/0138162 A1* 6/2006 Anderson ..... A61J 7/0076 221/288
2009/0294521 A1* 12/2009 de la Huerga ..... A61J 1/035 235/375
2010/0142330 A1* 6/2010 Reygaert ..... A61J 7/0481 368/10
2011/0119090 A1* 5/2011 Lazar ..... A61J 1/14 705/3
2012/0003928 A1* 1/2012 Geboers ..... A61J 7/0084 455/41.1
2013/0256331 A1* 10/2013 Giraud ..... B65D 83/0409 221/1

FOREIGN PATENT DOCUMENTS

WO 2009/080309 A2 7/2009
WO 2011/154018 A1 12/2011

* cited by examiner

ADD-ON UNIT FOR A HANDHELD CONTAINER FOR STORING OBJECTS

FIELD OF THE INVENTION

The invention relates to an add-on unit for a handheld container for storing objects and a hand held container provided with the add-on unit.

BACKGROUND OF THE INVENTION

WO2005004786 discloses an add-on unit for a hand-held medicine container for storing pills. The add-on unit is a dispenser which can be mounted on the container by screwing the dispenser on the neck of the container. The dispenser is provided with a dispensing indicator for indicating the number of pills left in, or dispensed from, the dispenser. The dispenser has a dispensing mechanism which can be actuated by the patient to dispense the pills one by one. The dispensing indicator is integrated with the dispenser such that it is automatically updated in response to the dispensing of the unit products therefrom. This information on the dispenser indicator is very helpful for the patient, since it can be used by the patient or care supplier in supporting the patient to stay in compliance with the prescribed therapy.

Although such dispensers can be very helpful, they are not yet widely used. A major disadvantage of these dispensers is that they are complex and expensive.

SUMMARY OF THE INVENTION

It is an object of the invention to provide an add-on unit and handheld container which enables monitoring of the object dispensing in a simple and cost effective way.

According to the invention this is achieved by an add-on unit for a handheld container for storing objects, which add-on unit comprises an open channel through which the objects can enter and/or leave the container which channel enables a free passage of the object through the channel under influence of a gravity force without a use of a dispensing mechanism, the add-on unit further comprises a detection part for detecting the passages of the objects through the channel, electronic circuitry comprising a processing part coupled to the detector part and arranged to derive information related to one or more detected passages of objects and an interface part for outputting the information.

When the handheld container is provided with the add-on unit according to the invention a user can move the objects in the direction of the channel in a natural way by keeping the container in a slanting upside down position and carefully shaking the container, resulting in that the object will pass the channel and leave the container. As soon as the object has left the container the user can stop the shaking. In this way a user can achieve the dispensing of a single object. This dispensing is detected and information related to the dispensing is output by means of the interface. In this way complex and expensive mechanisms for transporting pills are made superfluous. This makes the add-on unit so cheap that it can used as a disposable. This is contrary to the prior art add-on unit in which costs of the add-on unit are so high that it practically can only be used in applications where it can be re-used. Re-use requires several additional actions. Often such actions are experienced as annoying and/or people lack the required discipline to perform the actions which leads to a low acceptance of the prior art add-on units.

In an embodiment the add-on unit is an insert unit an which fits in a neck opening of the handheld container.

The insert unit can easily be inserted in the neck of the container, in particular in standard sized containers, in the filling process at a filling station, Due to the use of an insert unit only a simple additional step in the container filling process is required. Moreover the addition of the insert unit does not change the form factor of the container. So no additional measures are required for packaging and storing the containers.

In an embodiment of the add-on unit the processing part is arranged to count objects passing the channel, wherein the information represents the result of the counting.

In a further embodiment of the add-on unit the detector part is arranged to detect a movement direction of the object moving through the channel and the processing part is arranged to count in a first count direction in response to a detection of an object moving in a first moving direction and count in a direction, opposite to the first count direction, in response to the detection of an object moving in a second moving direction opposite to the first moving direction.

This embodiment has the advantage that in case an unintended dispensed object is returned to the container the returned object is counted so that after the return of the object the count is still correct.

In this way reliable information is always available about the actual number of objects dispensed and/or the number of pills present in the container.

In another embodiment of the add-on unit the detector part comprises a light sensitive detector, whereby the light sensitive detector is placed at a location wherein the passages of the object in the channel cause a decrease of a light exposure of the light sensitive detector, whereby the circuitry is arranged to detect the passages of the objects on the basis of detected decreases of the light exposures.

Light sensitive detectors perform the detection contactlessly. This has the advantage that the moving of the objects passing the channel is not disturbed by the detector.

In another embodiment of the add-on unit, which is very suitable for use with medication objects, the processing part is arranged to determine times and/or dates of detections of the objects, wherein the information comprises information representing the determined times and/or dates.

This feature is very helpful for monitoring the therapy compliance or the therapy adherence.

In another embodiment of the add-on unit the detection part comprises sensors for measuring humidity, container movements and/or temperature whereby the processing part is coupled to the sensors, and wherein the stored information represents results of the measurements.

This embodiment enables monitoring whether the storing condition, i.e. the temperature, transport movements and humidity, stayed within a required bandwidth for maintaining the quality of the stored objects. So it can easily be checked whether the medication or other objects have been properly stored.

In another embodiment, in the add-on unit inserted in the container the circuitry stores an inerasable Unique Identification Number readable via the interface part.

The Unique Identification Number can be used as a guarantee of the authenticity of the medication. The Unique Identification Number can also be used for tracking and tracing of individual containers.

The electronic interface part of the add-on unit inserted in the container is preferably arranged for wireless transfer of the information to a wireless receiver.

In particular the interface is arranged for Near Field Communication (NFC). This enables communication with modern Smartphones which are equipped with NFC technology, so that specialized equipment for communication with the container is superfluous, which makes the add-on unit even cheaper. By installing a dedicated App on the Smartphone easy access to the data stored in the add-on unit inserted in the container can be realized.

In an embodiment of the add-on unit the circuitry comprises a memory, the interface part is arranged for bidirectional communication and the electronic circuitry is arranged to write and read information to and from the memory via the interface part which information represents for instance data out of the group, production related data, packaging related data, drug identification data, patient identification data and medication regime related data. The data can be logged into a central database of the producer and/or packager and/or medical specialist and/or pharmacist monitoring the medication compliance of the patient.

An embodiment of the add-on unit comprises a mechanical construction forming a funnel for the objects to the channel.

Preferably the funnel is provided with obstacles for breaking the stream of objects to the channel.

By breaking the stream it is achieved that the objects are coming out one-by-one.

It is interesting to fix the add-on unit inseparably in the neck of the container by heat seal bonding, gluing or any other mounting technique preventing removal of the unit without destroying the container part and/or add-on unit.

This prevents unnoticed access to the objects included in the container, making tracing and tracking of the objects more reliable. Other aspects, embodiments, and features of the container and add-on unit and further benefits will be apparent upon review of the present description.

BRIEF DESCRIPTION OF DRAWING FIGURES

Figure 2:
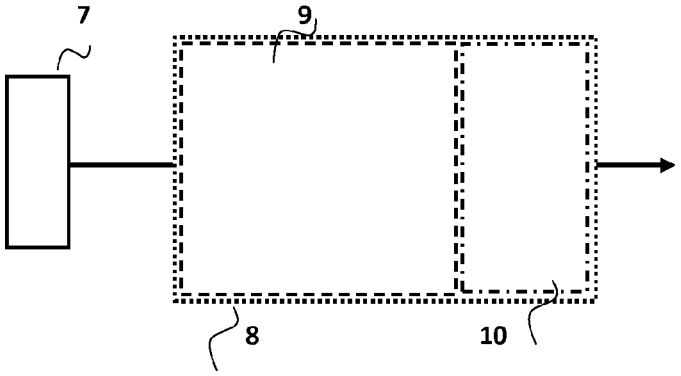
Figure 3:
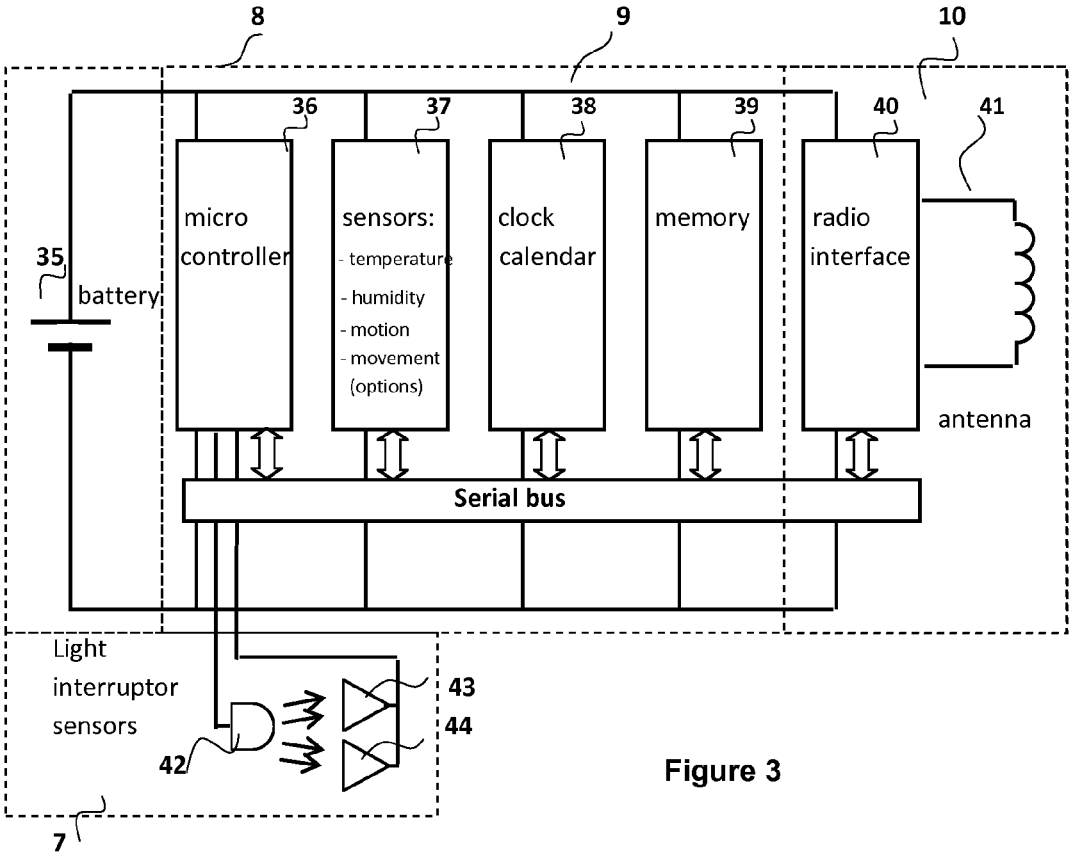
Figure 4:
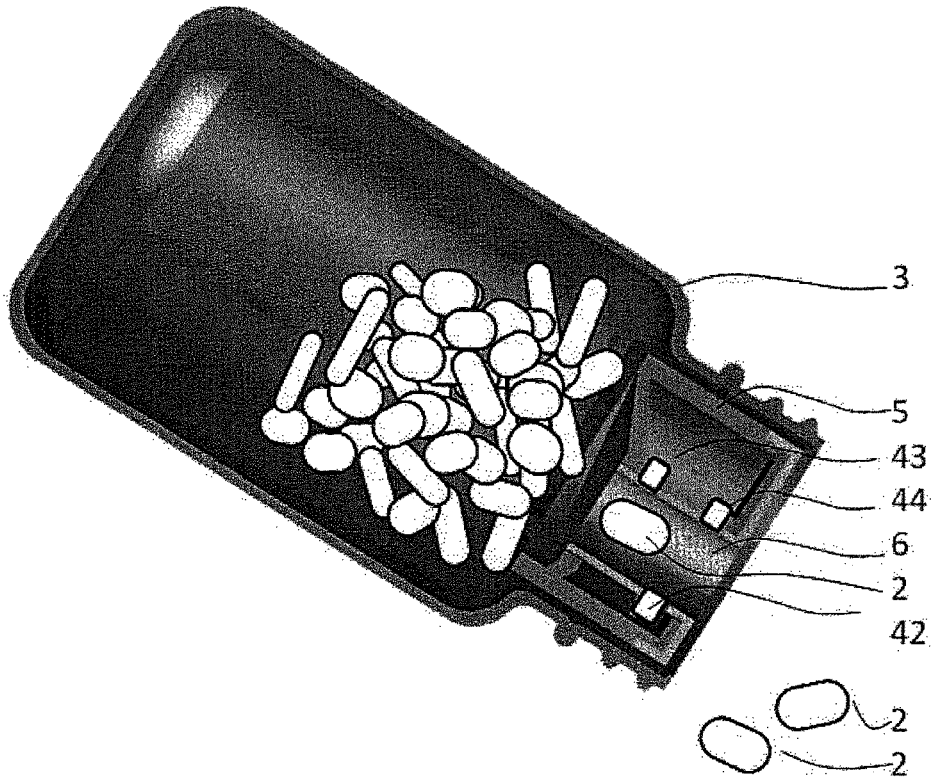
Figure 4A:
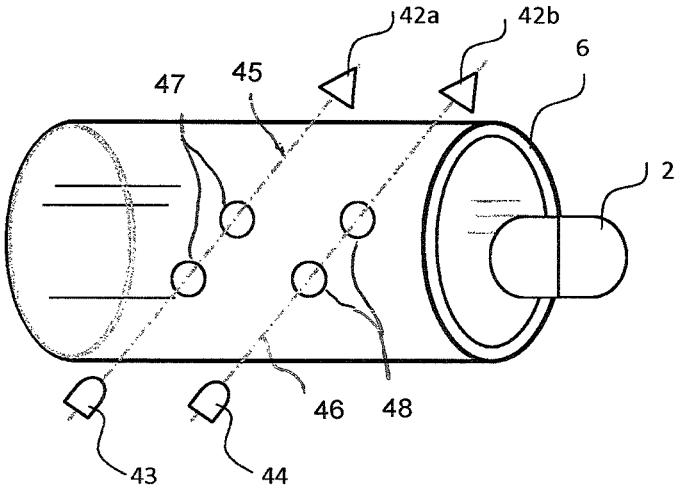
Figure 5:
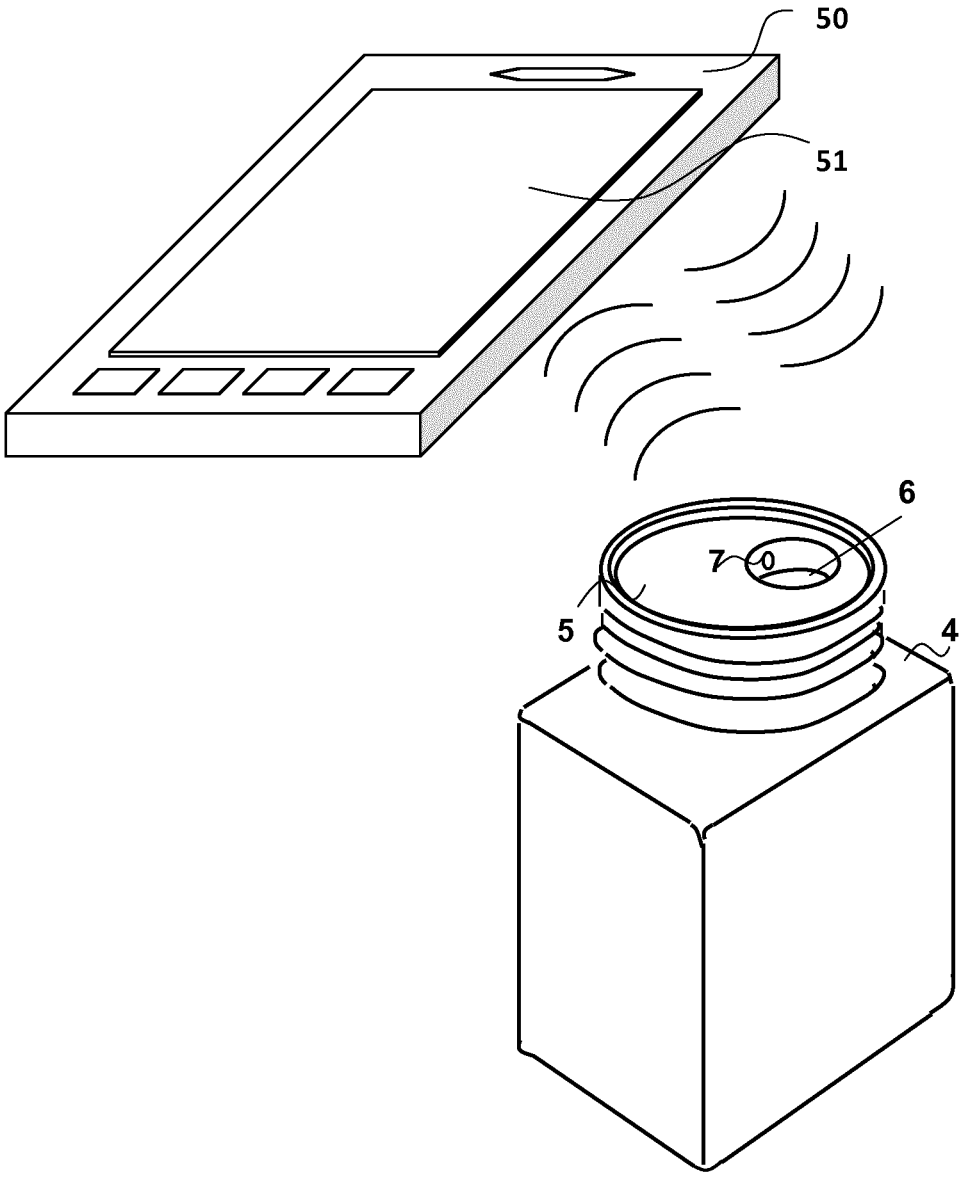
Figure 6:
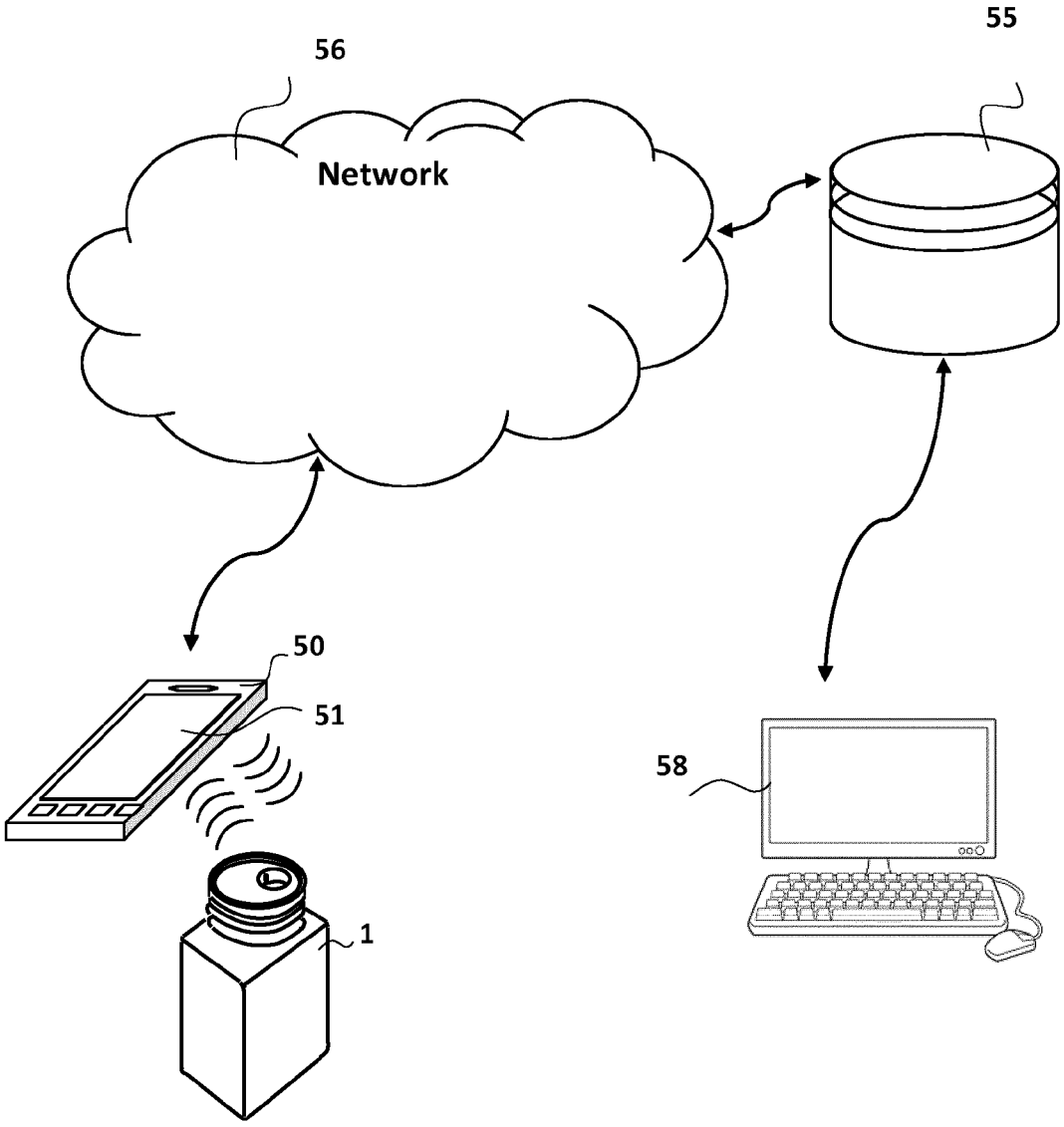
Figure 7:
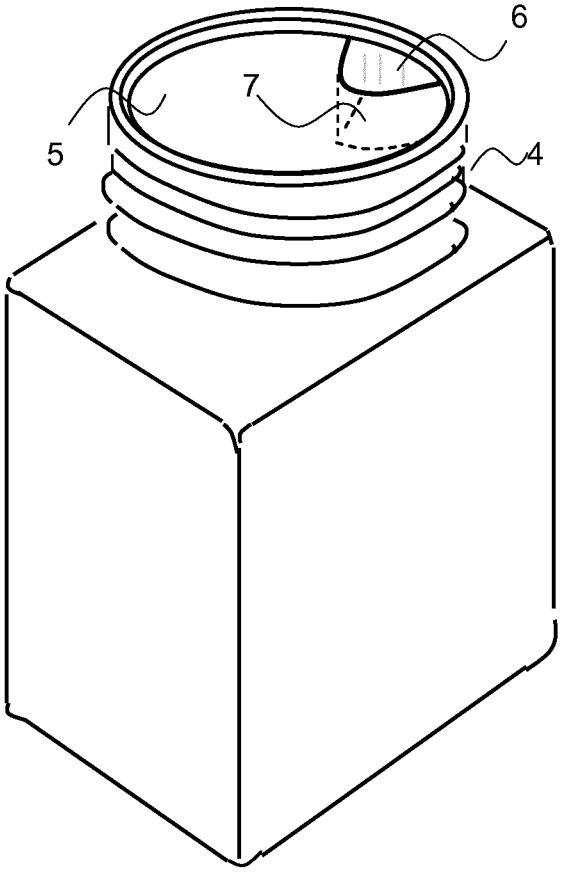
Figure 8:
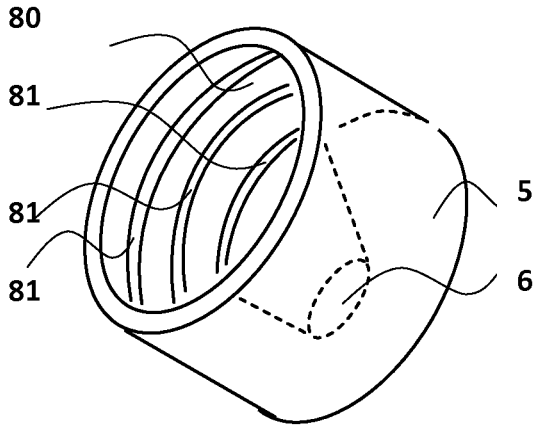
Figure 9:
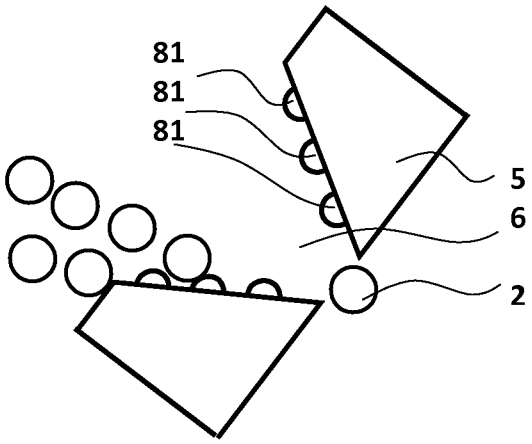

Embodiments of the invention will be described, by way of example only, with reference to the drawings, in which FIG. 1 shows an embodiment of a container, in the form of a medication container, provided with an add-on unit according to the invention in the form of an insert unit, FIG. 2 shows a brief overview of the electronics used in the insert unit, FIG. 3 shows a more detailed embodiment of the electronics, FIG. 4 shows an embodiment of a medication container provided with the insert unit in which an electronic eye is used for detection of pills leaving/entering the medication container, FIG. 4*a* shows an alternative embodiment of the electronic eye, FIG. 5 shows a combination of a medication container with insert unit and Smartphone, which are provided with NFC-technology for wireless information transfer between them, FIG. 6 shows the combination of medication container with insert unit and Smartphone embedded in a network for transferring information stored in the medication container to a remote database, FIG. 7 shows another embodiment of the medication container provided with another embodiment of the insert unit, FIG. 8 shows a 3D illustration of a funnel for guiding pills to be dispensed to the channel of the insert unit, and FIG. 9 shows a cross section of the funnel.

DETAILED DESCRIPTION

The description of illustrated embodiments and variations in this specification is only illustrative of the many embodiments of the invention within the scope of one or more of the claims. The inventor does not intend to limit the scope of the claims by reference to specific embodiments, unless done expressly.

The invention will be explained with reference to a medication container for storing medication objects to be dispensed and which is provided with an add-on unit in the form of an insert unit.

Such medication container can be used at home or in health care facilities such as hospitals, nursing homes, and assisted living facilities to improve compliance and more efficiently dispense medication. Although the invention is very suitable to be used in medication containers, it shall be noted that the invention is not limited to insert units for medication containers. The invention can also be used in other type of containers, such as containers for storing other objects to be dispensed such as e.g. sweets or small technical parts.

It shall be noted that the term medication object shall be given a broad interpretation, so that it also includes objects containing food supplements or any substance having a curative, healing, therapeutic or cosmetic effect on a living being. Further it shall be noted that instead of pills the medication objects can be any other type of solid preparations in general, and pharmaceutical, nutritional or confectionary dosage forms in particular, like capsules, tablets, granulate, dragees, lozenges, suppositories, or other uniform solid dosage forms, or other discrete objects of any kind; the solid preparations having the spatial dimensions of a tablet, capsule or pill, e.g. the size and/or shape of a tablet, capsule or pill, in particular tablets, capsules and pills themselves being preferred. The medication container can be configured to support a range of tablet sizes and shapes, such as circular, oblong, or irregularly shaped.

FIG. 1 shows an embodiment of the medication container 1 provided with an add-on unit according to the invention in the form of an insert unit 5. The medication container 1 stores medication objects in the form of pills 2.

The medication container 1 comprises a medication object storing part in the form of a standard medication bottle 3. The medication bottle 3 is provided with a neck 4 on which a cap (not shown) can be placed to close the bottle 3. The insert unit 5 is placed in the opening of the neck 4 of the container 1.

The outer dimensions of the insert unit 5 fit with the inner dimensions of the neck 4 so that it can be inserted and fixed in the neck 4. The enclosure can be made of plastic or other suitable material, preferably material that can be fixed by heat seal bonding, gluing or any other mounting technique preventing removing of the unit without destroying the container part and/or insert unit.

The insert unit 5 is provided with a channel 6, for example in the form of a tube, with dimensions enabling a free passage of the pills 2 through the channel 6 under influence of a gravity force without a use of a dispensing mechanism. A pill 2 is dispensed when a user puts the bottle in the position that a pill can fall through the channel 6. The insert unit 5 is provided with a detector 7 which is placed to detect a pill 2 passing the channel 6.

Further the insert unit comprises electronic circuitry 8 (FIG. 2), comprising a processing part 9 coupled to the detector 7 and arranged to derive and preferably store in a non-volatile memory information related to one or more detected passages of the pills 2 and an interface part 10 for outputting the information derived.

The detector 7 can be any detector suitable to detect the passage of the pill 2. Preferably a movement direction sensitive detector is used which is able to detect the movement direction of the pill 2, so that the detector 7 can detect whether a pill 2 is entering or leaving the medication container 1.

The processing part 8 can derive any information related to the detection of the passage of a pill, e.g. it can generate a signal indicating that a pill passed the channel and forward this signal to the interface part 10 which outputs this signal to the outside world where it can be further processed. In this case no storage of the derived information is required.

The processing part 9 can be provided with a built-in clock/calendar and arranged to register in a memory the time and date that a pill 2 has left or entered the medication container 1.

In an embodiment of the medication container the processing part comprises a counter for counting the detected passages of pills 2 and storing the result of the counting. This count represents information about the number of pills 2 which have left the medication container 1. In case the counter is pre-set with the number of pills in the medication container just after filling the medication container 1 and the counter is arranged to count down the count represents the number of pills which are still stored in the medication container 1. It is also possible to count the number of pills 2 dispensed. If information about the pills 2 originally stored is available in the memory, then information about the number of pills 2 dispensed and the number of pills still in the medication container 1 is known.

It may occur that a user has unintentionally dispensed a pill from the medication container 1 and then returns the pill 2 to the medication container 1. In order to prevent that the count incorrectly indicates the pills left/dispensed preferably the movement direction sensitive detector is used in combination with an up/down counter, counting down in response to a detected pill leaving the medication container 1 and counting up in response to a detection of a pill entering the medication container 1 or vice versa.

The interface part 10 outputs the information derived by the processing part (e.g. the count) to the outside world. The interface part can comprise a display displaying the count to the user of the bottle 3.

Preferably the interface part 10 is of a type that outputs the information via a wired or wireless communication channel to equipment outside the medication container for further processing.

In case the interface part 10 is arranged for Near Field Communication the information can easily be transferred and displayed on an NFC enabled Smartphone loaded with a dedicated App for reading information stored in a memory of the electronic circuitry 8 and displaying information based on the information read from the memory of the electronic circuitry 8.

Other communications technologies suitable for longer range wireless communications can also be used, such as Bluetooth and Wi-Fi or other wireless local area network (WLAN) technology. Of course, the communication technology used by the reader-writer should be compatible with the communication technology used by the interface of the medication container.

Alternatively, a physical electrical connection between the medication container 1 and a docking station could be used, assuming that the medication container 1 includes an appropriate interface. For example, if the medication container has a USB interface, it can be possible to connect it to the docking station (or directly to a USB-equipped external computer) using the USB interface.

FIG. 3 shows a detailed embodiment of the electronic circuitry 8. Electronic circuitry 8 comprises a battery 35 for powering the electronic circuitry 8. The processing part 9 comprises a microcontroller 36, a clock/calendar IC 38, and a non-volatile memory 39. The interface part 10 of the electronic circuitry 8 comprises a radio interface IC 40 and an antenna 41 for wireless communication. The radio interface is based on Near Field Communication (NFC) technology which is an RFID technique at a frequency of 13.56 MHz. This frequency is chosen to realise an inductive coupling between two devices so that data can be transferred from one device to another. The radio interface acts as a so-called type 2 tag or any of the other protocols as specified in the NFC-IP1 and NFC-IP2 specifications. In case the container is used for storing medicines the battery 35 is preferably put in an enclosure such that the air in the enclosure cannot come in contact with the medicines in the container and consequently battery caused contamination of the medicines is prevented. For similar reasons it makes sense to also put the electronic circuitry 8 and interface part 10 in the enclosure together with the battery 35.

Preferably the detector 7 is a contactless detector, such as a so called electronic eye, so as to prevent that the detector disrupts the moving of the pills through the channel 6. The electronic eye shown in FIG. 4, comprises a light source 42, e.g. a LED and two light interruption detectors 43 and 44. The light source 42 transmits light to the light interruption detectors 43 and 44. The light source 42 and light interruption detectors 43 and 44 are located at opposite sides of the opening 6 such that a pill 2 leaving the container first interrupts the light sent to light interruption detector 43 and subsequently interrupts the light sent to light interruption detector 44 (see FIG. 4). The detectors 43 and 44 send a signal to the microcontroller 36 representing the light interruptions caused by the pill 2 passing the light interruption detectors 43 an 44. In case the pill 2 is leaving the container light interruption detector 43 will generate a light interruption signal followed by a light interruption signal generated by light interruption detector 44.

So the order of the generation of interruption signals enables the microcontroller to determine whether a pill 2 passing the detector 43 and 44 is leaving or entering the medication container 1. In the embodiment described above only one light source is used for exposing the light interruption detectors. However it may make sense to use two light sources 42*a* and 42*b* (see FIG. 4*a*), one (42*a*) sending a light beam 45 to detector 43 and one (42*b*) sending a light beam 46 to detector 44. This enables the use of small light beams 45 and 46 for the exposure of the detectors 43 and 44, e.g. by using lasers or LEDs for the light sources 42*a* and 42*b*. When small light beams are used the interference between the detections by the detectors 43 and 44 is very small or even absent.

The insert is preferably arranged such that in case the add-on is added to the container, light originating from an environment of the insert unit cannot directly reach the light sensitive detector. In the embodiment shown in FIG. 4*a* this is realized by using a channel which is made of non-transparent material having transparent parts 47 and 48 at the places where the detectors 43 and 44 are located.

The microcontroller 36 counts up when a pill leaves the container 1 and counts down when a pill enters the container. The result of the counting represents the number of pills removed from the bottle.

The count is stored in the non-volatile memory 39.

Optionally information including patient data can also be stored in the memory 39.

The electronic circuitry 8 optionally contains other functions 37, such as a temperature sensor, humidity sensor and/or movement sensor coupled to the microcontroller 36. The temperature at which the medication objects are stored is important for medication which is temperature sensitive. This includes but is not limited to bio-medications which must be stored under strict environmental conditions. The temperature sensor measures the temperature conditions in the medication container 1 and stores these measurements in the memory 39 from the moment the pills are packed until the moment the medication is used by the patient. Medication sensitive to humidity can be monitored by the humidity sensor in the medication container which measures the humidity and stores the measurements in the memory 39. The packaging and production environmental conditions and the during usage of the medication can also be stored in the memory 39 and can be read by the professional readers or by the patient using their Smartphone. The use of the movement sensor is important for bio-medication liquids which can be packed into capsules. When the medication container 1 is used for such medication, the movement sensor can be enabled to detect that the medication container has been handled correctly during transport and not exposed to movements of a level which adversely affect the quality of the medication.

Optionally the container is provided with a detector (not shown) to detect whether the container is closed by the cap. This detector is coupled to the microcontroller 36. When a removal of the cap is detected the microcontroller is woken up from the power-down mode and switches on the light emitting source 42, resulting in an energy efficient operation of the electronic circuit 8.

In another embodiment a position detector can be used to detect whether the bottle is in an upright position or an upside down position, enabling the pills 2 to leave the container. The output of the position detector is used to wake up the electronic circuitry 8. Preferably the insert unit is reset to the power-down mode a predetermined period, e.g. a few minutes, after the position detector has detected that the container has been placed in the upright position again, so that the return of unintentionally dispensed pills 2 are counted when they are returned shortly after they were dispensed.

When an NFC reader/writer device 50 is applied to the antenna 41, as shown in FIG. 5, the microcontroller 36 is woken up by the electromagnetic field of the NFC reader/writer device 50 which is detected by the field detector circuitry of the NFC interface IC 40. The use of this NFC technology has the advantage that the part in the insert unit is not radiating electro-magnetic power, so it has no influence on the medication inside the container. The reader/writer device 50 transmits a request to the radio interface IC 40 to receive the content of memory 39 and the information stored in the memory 39 is transmitted to the reader device 50. The reader/writer device 50 can be any device connected to a PC or a terminal having an NFC interface such as an NFC enabled Smartphone. The information read from the memory is translated into a user readable message on the display 51 of the reader/writer device 50 or a PC coupled to the reader writer device 50. For example, a patient can read the information from the medication container 1 and can see the time and date when he or she removed a pill from the medication container 1. Additional information such as the number of pills still available or information about the medication in the bottle can also be displayed. When the memory 39 of medication container 1 is read by the reader/writer device 50 the memory content of the medication container can also be transferred to a remote database 55 via a network 56, for example the internet, as shown in FIG. 6. The data in the database is accessible by one or more computers 58.

The content of memory 39 is programmable so that during the production on the bottle filling machine information about the medication objects stored in the medication container 1, the packing condition, the environmental conditions and other logistical data can be programmed into the memory 39. When the medication container 1 is distributed via a pharmacist or other caregiver more details of the medication and a patient receiving the medication container 1 can be programmed into the memory 39. Information including a patient's therapy regimen and further information about the medication objects inside the medication container 1 can also be stored in the memory 39. The patient and/or caregiver can check the times at which they took their pills from the medication container 1 and compare the time and date with the doctor's prescription by means of the Smartphone app on an NFC enabled Smartphone or by means of the application program on a PC.

The NFC enabled Smartphone with the special reader App installed and having a network connection can also be used to read other data from this medication container which is for instance data measured by the sensors 37 in the medication container 1 and stored in the memory 39. The data is displayed on the users Smartphone and optionally can be transmitted via the Internet to a remote database for storage and/or analysis by the caregiver. The insert unit 5 is preferably mounted in such a way that it is irremovable from the bottle neck 4.

This is achieved by using techniques such as welding, sealing or gluing. The enclosure of the medication container 1 can't be opened to remove the electronic circuitry and can't be removed without causing visible damage.

Optionally the electronic circuitry 8 contains an IC which includes RFID functionality such as an inerasable UID (Unique Identification) used for authentication and tracking and tracing of the medication container. The original manufacturer of the content of the medication container, for instance a pharmaceutical company using a medication container of this type on their production lines, can use this UID for anti-counterfeiting and track and trace purposes in the logistics chain. Each medication container can be followed from the production date and time right through to when it is used by the client. The NFC interface of the medication container can transmit the UID so that the client using the medication objects stored in the medication container can check the origin of the medication objects by the means of an app on the NFC enabled Smartphone.

When the medication container is used in medication containers for clinical trials or other studies, it is important to know the number of pills in the bottle when it is returned to the clinical site. Currently the bottle content is counted manually and this problem can be solved by using this dispenser insert unit. When the medication is returned, the NFC reader/writer device reads the number dispensed and the total number at the filling moment and immediately gives the number of pills left in the bottle.

The embodiment described in the preceding comprises a standard bottle 3 in which an insert unit 5 is fixed in the neck of the bottle 3. It is to be noted that, although an insert unit is very advantageous to be used, add-on units which can be fixed to the container in another manner than inserting it in the neck of the container can be used. For example add-on units which can be clicked over the neck of the container or can be screwed on the neck of the container can be used. It is further to be noted that instead of using a separate add-on unit the part including the channel 6 and the electronic circuitry 8 can be at least partly an integral part of the medication container 1.

Also other forms than bottle shaped forms can be used for the medication storing part 3 of the medication container 1. The invention is applicable for containers of any form and size which is suitable for storing the objects to be dispensed and can be taken in the hands of a user to shake the container, so as to cause a dispensing of one of the objects stored in the container.

It has to be understood that it is not required that the channel 6 is fully enclosed by the insert unit 5. FIG. 7 shows an embodiment of the container 1, wherein the channel 6 is formed by an open space left between the container part 3 and the insert unit 5 when the insert is fixed to the container part.

FIG. 8 shows an alternative mechanical construction of the enclosure of the insert unit 5. The embodiment of FIG. 8 comprises a funnel 80 for guiding the medication objects to the channel. The wall of the funnel 80 is provided with ribs 81.

The function of the ribs 81 is explained with reference to FIG. 9, which shows a cross section of the funnel 80. By keeping the medication container in a slanting position while shaking it, a stream of pills 2 is moving in the direction of the channel 6. The ribs 81 form obstacles for the pills 2 and break the stream of pills 2, resulting in that the pills are coming out the medication container 1 one-by-one. It will be clear for the man skilled in the art that other obstacles than ribs can be used for breaking the stream of pills 2.

In the preceding embodiment the funnel 80 is an integral part of the insert unit 5. The funnel 81 can alternatively be a separate part or a part of the medication object storing part.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practising the claimed invention, from a study of the drawings, the disclosure, and the appended claims. In the claims, the word "comprising" does not exclude other elements or steps, and the indefinite article "a" or "an" does not exclude a plurality. A single processor or controller or other unit can fulfill the functions of several items recited in the claims. The mere fact that certain measures are recited in mutually different dependent claims does not indicate that a combination of these measures cannot be used to advantage. Any reference symbol in the claims should not be construed as limiting the scope.

What is claimed is:

1. Add-on unit for a handheld container for storing objects, which add-on unit comprises:

an open channel through which the objects can enter and leave the container, which channel enables a free passage of the objects through the channel under influence of a gravity force, a detection part for detecting the passages of the objects through the channel, electronic circuitry comprising:

a processing part coupled to the detector part and arranged to derive information related to at least one detected passage of the objects and an interface part for outputting the information.

2. Add-on unit as claimed in claim 1, whereby the detection part comprises a direction sensitive detector to detect whether the object is entering or leaving the container.

3. Add-on unit as claimed in claim 1, whereby the add-on unit comprises an insert unit which fits in a neck of the handheld container on which neck a cap is adapted to be placed to close the container and whereby outer dimensions of the insert unit fit with inner dimensions of the neck.

4. Add-on unit as claimed in claim 1, wherein the processing part is arranged to count objects passing through the channel, wherein the information represents the result of the counting.

5. Add-on unit as claimed in claim 4, wherein the detector part is arranged to detect a moving direction of the object moving through the channel and the processing part is arranged to count in a first count direction in response to a detection of an object moving in a first moving direction and to count in a direction, opposite to the first count direction, in response to the detection of an object moving in a second moving direction opposite to the first moving direction.

6. Add-on unit as claimed in claim 1, wherein the detector part comprises a light sensitive detector, whereby the light sensitive detector is placed at a location wherein the passages of the object in the channel cause a decrease of a light exposure of the light sensitive detector, whereby the circuitry is arranged to detect the passages of the objects on the basis of detected decreases of the light exposures.

7. Add-on unit as claimed in claim 6 wherein the detector part comprises a light source for generating light exposing the light sensitive detector.

8. Add-on unit as claimed in claim 5, wherein the detector part comprises two light sensitive detectors located along a path to be followed by objects through the channel, and two light sources arranged to send two separated light beams to the light sensitive detectors, a first one of the light beams is directed to a first one of the light sensitive detectors and a second one of the light beams is directed to a second one of the light detectors and whereby the locations of the light sources and light sensitive detectors are such that each of the objects passing the channel interrupts the two light beams at different moments in time so as to enable the detection of the moving direction.

9. Add-on unit as claimed in claim 6, wherein the location of the light sensitive detector is such that, in case the add-on is added to the container, light originating from an environment of the container cannot directly reach the light sensitive detector.

10. Add-on unit as claimed in claim 1, wherein the processing part is arranged to determine times and/or dates of detections of the objects, wherein the information comprises information representing the determined times and/or dates.

11. Add-on unit as claimed in claim 1, wherein the detection part comprises sensors for at least one of measuring humidity, add-on unit movements and temperature whereby the processing part is coupled to the sensors, and wherein the stored information represents results of the measurements.

12. Add-on unit as claimed in claim 1, wherein the circuitry stores an inerasable Unique Identification Number readable via the interface part.

13. Add-on unit as claimed in claim 1, wherein the interface part is arranged for wireless transfer of the information to a wireless receiver.

14. Add-on unit as claimed in claim 13, wherein the interface part is arranged for Near Field Communication (NFC).

15. Add-on unit as claimed in claim 1, wherein the electronic circuitry is arranged to provide an RFID function enabling tracking and tracing of individual add-on units.

16. Add-on unit as claimed in claim 1, wherein the circuitry comprises a memory and wherein the interface part is arranged for bidirectional communication and wherein the electronic circuitry is arranged to write and read information to and from the memory via the interface part which information represent at least data out of a data group comprising production related data, packaging related data, drug identification data, patient identification data and medication regime related data.

17. Add-on unit as claimed in claim 1 comprising a mechanical construction forming a funnel for guiding the objects to the channel.

18. Add-on unit as claimed in claim 17, whereby the funnel is provided with obstacles for the objects which obstacles are arranged to break a stream of objects moving via the funnel in a direction of the channel.

19. Add-on unit as claimed in claim 18, wherein the obstacles comprise ribs.

20. Add-on as claimed in claim 1, comprising a battery for energizing at least one of the electronic circuitry and the detecting part, wherein the battery is located in an enclosure disabling air contact with the objects stored in the container.

21. Add-on unit as claimed in claim 1, comprising a mode detector for detecting a use mode indicating that the container is placed in a state wherein an object can enter or leave the container, whereby the electronic circuitry is coupled to the mode detector and arranged to operate in an active mode and in an inactive mode in which at least a part of the circuitry and detection part is inactivated to reduce power consumption, whereby the circuitry is arranged to be brought in the active mode when the use mode is detected and to be brought in the inactive mode when no use mode is detected.

22. Add-on unit as claimed in claim 21 whereby the mode detection comprises a coverage detector for detecting a coverage of an end of the channel.

23. Add-on unit as claimed in claims claim 21, whereby the mode detector is arranged to detect when the container is turned upside down.

24. Add-on unit as claimed in claim 23, whereby the add-on unit is arranged to delay the switch to the operation to the inactive mode for a period after a detection that the container has been placed in the upright position, so as to enable the counting of objects entered in the container.

25. Handheld container provided with an add-on unit as claimed in claim 1.

26. Handheld container as claimed in 25, whereby the container is provided with a neck on which a cap is adapted to be placed to close the container and whereby the add-on unit is an insert unit which has been inserted in the neck, whereby outer dimensions of the insert unit fit with inner dimensions of the neck.

27. Container as claimed in claim 24, whereby the container is filled with the objects.

28. Container as claimed in claim 25, whereby the objects comprise objects selected from the group consisting of food supplements and any substance having a curative, healing, therapeutic or cosmetic effect on a living being.

29. Container as claimed in claim 25, whereby the add-on unit is inseparably fixed to the container part by any one of heat seal bonding, gluing any other mounting technique preventing removing of the unit without destroying the container part and add-on unit.

* * * * *